US011262132B2

(12) United States Patent
Maeda et al.

(10) Patent No.: US 11,262,132 B2
(45) Date of Patent: Mar. 1, 2022

(54) HEAT EXCHANGER AND REFRIGERATION CYCLE APPARATUS

(71) Applicants: Mitsubishi Electric Corporation, Tokyo (JP); The University of Tokyo, Tokyo (JP)

(72) Inventors: Tsuyoshi Maeda, Tokyo (JP); Shinya Higashiiue, Tokyo (JP); Akira Ishibashi, Tokyo (JP); Ryuichi Nagata, Tokyo (JP); Eiji Hihara, Tokyo (JP); Chaobin Dang, Tokyo (JP); Jiyang Li, Tokyo (JP)

(73) Assignees: Mitsubishi Electric Corporation, Tokyo (JP); The University of Tokyo, Tokyo (JP)

( * ) Notice: Subject to any disclaimer, the term of this patent is extended or adjusted under 35 U.S.C. 154(b) by 121 days.

(21) Appl. No.: 16/627,388

(22) PCT Filed: Aug. 3, 2017

(86) PCT No.: PCT/JP2017/028254
§ 371 (c)(1),
(2) Date: Dec. 30, 2019

(87) PCT Pub. No.: WO2019/026240
PCT Pub. Date: Feb. 7, 2019

(65) Prior Publication Data

US 2020/0217590 A1 Jul. 9, 2020

(51) Int. Cl.
*F28D 1/053* (2006.01)
*F28F 1/02* (2006.01)
(Continued)

(52) U.S. Cl.
CPC ..... *F28D 1/053* (2013.01); *F28F 1/022* (2013.01); *F25B 39/02* (2013.01);
(Continued)

(58) Field of Classification Search
CPC ..... F28D 1/053; F28D 2021/0068; F28D 2021/0084; F28D 1/00; F28D 7/00;
(Continued)

(56) References Cited

U.S. PATENT DOCUMENTS 4,071,934 A * 2/1978 Zolman ..... B21C 23/10 165/171
5,411,079 A * 5/1995 Sasaki ..... F28D 1/0246 165/151
(Continued)

FOREIGN PATENT DOCUMENTS

CN 1520509 A 8/2004
JP S52-050056 A 4/1977
(Continued)

OTHER PUBLICATIONS

International Search Report of the International Searching Authority dated Oct. 24, 2017 for the corresponding International application No. PCT/JP2017/028254 (and English translation).
(Continued)

*Primary Examiner* — Justin M Jonaitis
(74) *Attorney, Agent, or Firm* — Posz Law Group, PLC

(57) ABSTRACT

In a heat exchanger, each of a plurality of heat exchange members includes: a main body portion including a heat transfer pipe; and extending portions provided to the main body. The extending portions extend from ends of the main body portion in a third direction. When a dimension of the main body portion in the third direction is represented by La, a dimension of the extending portions in the third direction is represented by Lf, a dimension of a wall thickness of each of the heat transfer pipes is represented by tp, and a thickness dimension of each of the extending portions is represented by Tf, relationships: Lf/La≥1 and Tf≤tp are satisfied.

9 Claims, 10 Drawing Sheets

(51) Int. Cl.
*F25B 39/02* (2006.01)
*F28D 21/00* (2006.01)
*F28F 9/02* (2006.01)

(52) U.S. Cl.
CPC ..... *F28D 2021/0068* (2013.01); *F28D 2021/0084* (2013.01); *F28F 9/02* (2013.01); *F28F 2215/12* (2013.01)

(58) Field of Classification Search
CPC ..... F28D 1/05308; F28D 1/05358; F28D 1/05316; F28D 1/05366; F28F 1/022; F28F 9/02; F28F 2215/12; F28F 1/00; F28F 9/0246; F28F 9/04; F28F 1/24; F28F 1/32; F28F 1/12; F28F 1/10; F28F 1/04; F25B 39/02; F25B 39/00
USPC ..... 62/515; 165/172, 176, 175, 148, 151
See application file for complete search history.

(56) References Cited

U.S. PATENT DOCUMENTS

2004/0256093 A1 12/2004 Romero Beltran
2006/0243429 A1* 11/2006 Chu ..... F28F 3/025 165/109.1
2007/0034367 A1* 2/2007 Wieder ..... F28F 1/22 165/183
2009/0065183 A1* 3/2009 Uneno ..... F28F 3/048 165/152
2012/0031586 A1* 2/2012 Sugimura ..... F25B 39/04 165/104.21
2013/0206376 A1* 8/2013 Shikazono ..... F28D 21/0014 165/172
2015/0034289 A1* 2/2015 Seo ..... B23P 15/26 165/173

FOREIGN PATENT DOCUMENTS

JP S59-215569 A 12/1984
JP H03-096574 U 10/1991
JP 2005-140352 A 6/2005
JP 2006-084078 A 3/2006
JP 2008-202896 A 9/2008
WO 2012/142070 A1 10/2012

OTHER PUBLICATIONS

Office Action dated May 26, 2021, issued in corresponding CN Patent Application No. 201780093416.4 (and English Machine Translation).
Extended European Search Report dated Jun. 17, 2020 for the corresponding EP application No. 17920082.9.

* cited by examiner

FIG. 6

| | |
|---|---|
| WIDTH DIMENSION La OF MAIN BODY PORTION OF HEAT EXCHANGE MEMBER | 5.2mm |
| THICKNESS DIMENSION Ta OF MAIN BODY PORTION OF HEAT EXCHANGE MEMBER | 0.7mm |
| WIDTH DIMENSION Lt OF FLAT PIPE | 5.0mm |
| THICKNESS DIMENSION Tt OF FLAT PIPE | 0.6mm |
| WIDTH DIMENSION Lf1 OF FIRST EXTENDING PORTION | 7.4mm |
| WIDTH DIMENSION Lf2 OF SECOND EXTENDING PORTION | 7.4mm |
| THICKNESS DIMENSION Tf OF HEAT TRANSFER PLATE | 0.1mm |
| DIMENSION w OF MINIMUM CLEARANCE | 1.5mm |
| EACH OF ARRANGEMENT PITCHES FP OF HEAT EXCHANGE MEMBERS | 2.2mm |
| DIMENSION tp OF WALL THICKNESS OF FLAT PIPE | 0.2mm |
| DEPTH DIMENSION Tb OF FLAT PIPE | 0.4mm |
| WIDTH-DIMENSION RATIO R1 | 2.8 |
| THICKNESS-DIMENSION RATIO R2 | 7.0 |

HEAT EXCHANGER AND REFRIGERATION CYCLE APPARATUS

CROSS REFERENCE TO RELATED APPLICATION

This application is a U.S. national stage application of PCT/JP2017/028254 filed on Aug. 3, 2017, the contents of which are incorporated herein by reference.

TECHNICAL FIELD

The present invention relates to a heat exchanger including heat transfer pipes, and a refrigeration cycle apparatus including the heat exchanger.

BACKGROUND ART

There has hitherto been known a heat exchanger having the following configuration for easy drainage of dew condensation water adhering to surfaces of heat transfer pipes. Specifically, a plurality of the heat transfer pipes are arranged so that a pipe axis direction of each of the heat transfer pipes matches with a vertical direction. Projecting portions, which project from side surfaces of each of the heat transfer pipes, are formed along the pipe axis direction of each of the heat transfer pipes (see, for example, Patent Literature 1).

CITATION LIST

Patent Literature

[PTL 1] JP 2008-202896 A

SUMMARY OF INVENTION

Technical Problem

In the related-art heat exchanger disclosed in Patent Literature 1, however, the projecting portions, which are rising portions from the surfaces of each of the heat transfer pipes, are merely formed. Thus, a heat transfer area of each of the heat transfer pipes on an air stream side is insufficient. Thus, improvement of heat exchange performance between refrigerant flowing through the heat transfer pipes and the air stream cannot be achieved.

The present invention has been made to solve the problem described above, and has an object to provide a heat exchanger and a refrigeration cycle apparatus, with which the improvement of the heat exchange performance can be achieved.

Solution to Problem

According to one embodiment of the present invention, there is provided a heat exchanger, including a plurality of heat exchange members arranged side by side in a first direction so as to be spaced apart from each other, wherein each of the plurality of heat exchange members includes: a main body portion including a heat transfer pipe extending in a second direction intersecting with the first direction; and extending portions provided to the main body portion along the second direction, wherein the extending portions extend from ends of the main body portion in a third direction intersecting with both of the first direction and the second direction, and wherein, when a dimension of the main body portion in the third direction is represented by La, a dimension of the extending portions in the third direction is represented by Lf, a dimension of a wall thickness of each of the heat transfer pipes is represented by tp, and a thickness dimension of each of the extending portions is represented by Tf, relationships: $Lf/La \geq 1$ and $Tf \leq tp$ are satisfied.

Advantageous Effects of Invention

With the heat exchanger and the refrigeration cycle apparatus according to one embodiment of the present invention, heat exchange efficiency of the heat exchanger can be improved. As a result, the improvement of the heat exchange performance of the heat exchanger can be achieved.

BRIEF DESCRIPTION OF DRAWINGS

FIG. 6 is a table for showing dimensions of portions of the heat exchanger of FIG. 2.

DESCRIPTION OF EMBODIMENTS

Now, embodiments of the present invention are described with reference to the accompanying drawings.

First Embodiment

Figure 1:
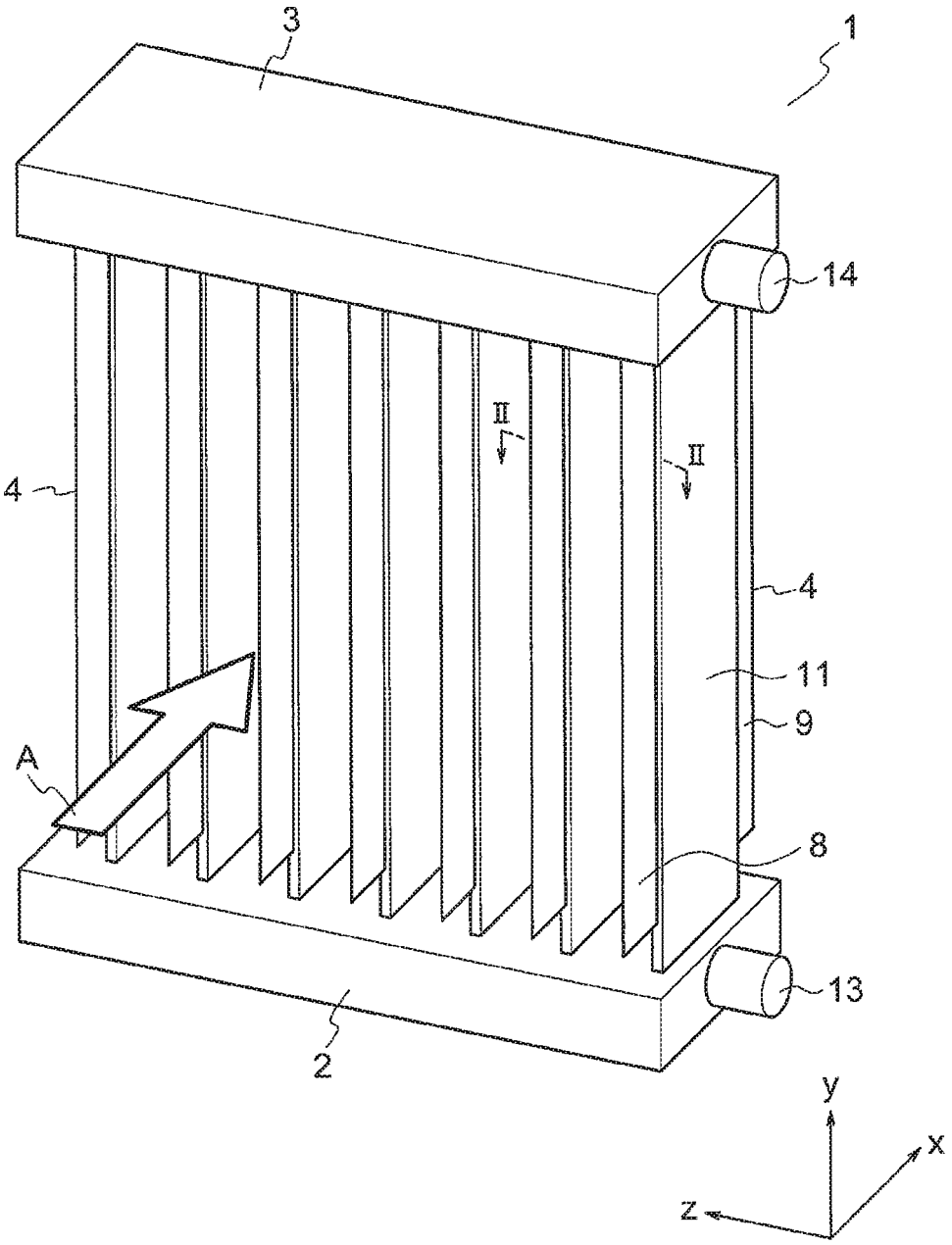
FIG. 1 is a perspective view for illustrating a heat exchanger according to a first embodiment of the present invention.
Figure 2:
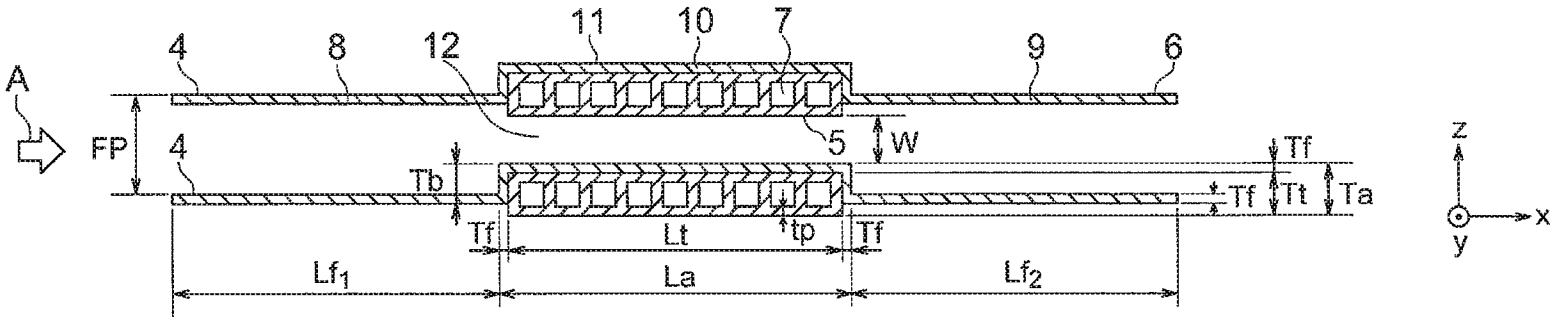
FIG. 2 is a sectional view taken along the line II-II of FIG. 1.

FIG. 1 is a perspective view for illustrating a heat exchanger according to a first embodiment of the present invention. FIG. 2 is a sectional view taken along the line II-II of FIG. 1. In FIG. 1, a heat exchanger 1 includes a first header tank 2, a second header tank 3, and a plurality of heat exchange members 4. The second header tank 3 is arranged so as to be apart from the first header tank 2. The plurality of heat exchange members 4 are each coupled to the first header tank 2 and the second header tank 3.

The first header tank 2 and the second header tank 3 are each a hollow container extending along a first direction z in parallel to each other. The heat exchanger 1 is arranged so that the first direction z, which is a longitudinal direction of the first header tank 2 and the second header tank 3, matches with a horizontal direction. Further, the second header tank 3 is arranged above the first header tank 2.

The plurality of heat exchange members 4 are arranged side by side between the first header tank 2 and the second header tank 3 so as to be spaced apart from each other. Further, the plurality of heat exchange members 4 are arranged side by side in the longitudinal direction of the first header tank 2 and the second header tank 3, specifically, the first direction z. No component of the heat exchanger 1 is connected to opposed surfaces of two adjacent heat exchange members 4, and the opposed surfaces serve as guide surfaces extending along a longitudinal direction of the heat exchange members 4. With the arrangement described above, when, for example, a liquid such as water adheres to the guide surfaces of the heat exchange members 4, the liquid is likely to be guided downward along the guide surfaces by its own weight.

Each of the plurality of heat exchange members 4 includes a main body portion 11, a first extending portion 8, and a second extending portion 9. The main body portion 11 extends from the first header tank 2 to the second header tank 3. The first extending portion 8 and the second extending portion 9 are provided to the main body portion 11.

The main body portion 11 includes, as illustrated in FIG. 2, a heat transfer pipe 5 and an overlapping portion 10 having a plate shape. The overlapping portion 10 overlaps an outer peripheral surface of the heat transfer pipe 5. The first extending portion 8 and the second extending portion 9 are continuous with the overlapping portion 10. In this example, the first extending portion 8, the second extending portion 9, and the overlapping portion 10 form a heat transfer plate 6. In this example, the heat transfer plate 6 is a single member, and the heat transfer plate 6 is a member separate from the heat transfer pipe 5.

Each of the heat transfer pipes 5 extends along a second direction y intersecting with the first direction z. Specifically, a pipe axis of the heat transfer pipe 5 extends along the second direction y. The heat transfer pipes 5 are arranged in parallel to each other. In this example, the second direction y, which is a longitudinal direction of the heat transfer pipes 5, is orthogonal to the first direction z. Each of the plurality of heat exchange members 4 is arranged so that the longitudinal direction of the heat transfer pipes 5 matches with a vertical direction. A lower end of each of the heat transfer pipes 5 is inserted into the first header tank 2, and an upper end of each of the heat transfer pipes 5 is inserted into the second header tank 3.

A sectional shape of each of the heat transfer pipes 5 when the heat transfer pipe 5 is cut along a plane orthogonal to the longitudinal direction of the heat transfer pipes 5 is a flat shape having a long axis and a short axis, as illustrated in FIG. 2. Specifically, in this example, each of the heat transfer pipes 5 is a flat pipe. When a long axis direction of a cross section of the heat transfer pipe 5 is set as a width direction of the heat transfer pipe 5 and a short axis direction of the cross section of each of the heat transfer pipes 5 is set as a thickness direction of each of the heat transfer pipes 5, the width direction of each of the heat transfer pipes 5 matches with a third direction x intersecting with both of the first direction z and the second direction y. In this example, the third direction x is a direction orthogonal to both of the first direction z and the second direction y. As a result, in this example, the thickness direction of each of the heat transfer pipes 5 matches with the longitudinal direction of each of the first header tank 2 and the second header tank 3, specifically, the first direction z. Further, in this example, each of the plurality of heat transfer pipes 5 is arranged on a straight line extending along the first direction z. A width direction of each of the main body portions 11 matches with the width direction of each of the heat transfer pipes 5, and a thickness direction of each of the main body portions 11 matches with the thickness direction of each of the heat transfer pipes 5.

In each of the heat transfer pipes 5, as illustrated in FIG. 2, there are provided a plurality of refrigerant flow passages 7 through which refrigerant flows. The plurality of refrigerant flow passages 7 are arranged side by side from one end in the width direction of each of the heat transfer pipes 5 to another end in the width direction. In the heat transfer pipe 5, a portion located between an inner surface of each of the refrigerant flow passages 7 and the outer peripheral surface of the heat transfer pipe 5 corresponds to a wall thickness portion of the heat transfer pipe 5.

The heat transfer pipe 5 is made of a metal material having heat conductivity. As the material for forming the heat transfer pipe 5, for example, aluminum, an aluminum alloy, copper, or a copper alloy is used. The heat transfer pipe 5 is manufactured by extrusion for extruding a heated material through a hole of a die to form the cross section of the heat transfer pipe 5. The heat transfer pipe 5 may be manufactured by drawing for drawing a material through a hole of a die to form the cross section of the heat transfer pipe 5.

In the heat exchanger 1, an air stream A, which is an air flow generated by an operation of a fan (not shown), passes between the plurality of heat exchange members 4. The air stream A flows while coming into contact with the first extending portions 8, the second extending portions 9, and the main body portions 11. With the flow of the air stream A, heat is exchanged between refrigerant flowing through the plurality of refrigerant flow passages 7 and the air stream A. In this example, the air stream A passes between the plurality of heat exchange members 4 along the third direction x.

The heat transfer plates 6 are made of a metal material having heat conductivity. As the material for forming the heat transfer plates 6, for example, aluminum, an aluminum alloy, copper, or a copper alloy is used. A thickness dimension of each of the heat transfer plates 6 is smaller than a thickness dimension of each of the heat transfer pipes 5.

The overlapping portion 10 is arranged to extend from one end of the heat transfer pipe 5 in the width direction to another end thereof in the width direction along the outer peripheral surface of the heat transfer pipe 5. Further, the overlapping portion 10 is fixed to the heat transfer pipe 5 through intermediation of a brazing filler metal having heat conductivity. With use of the brazing filler metal, the first extending portion 8, the second extending portion 9, and the overlapping portion 10 are thermally connected to the heat transfer pipe 5. The heat exchanger 1 is manufactured by heating an assembled body including the first header tank 2, the second header tank 3, the heat transfer pipes 5, and the heat transfer plates 6 in a furnace. A surface of each of the heat transfer pipes 5 and a surface of each of the heat transfer plates 6 are covered in advance with the brazing filler metal. The heat transfer pipes 5, the heat transfer plates 6, the first header tank 2, and the second header tank 3 are fixed together with the brazing filler metal, which is molten by heating in the furnace. In this example, part of the surface of each of the heat transfer plates 6 covered with the brazing filler metal is only a surface of the overlapping portion 10, which is located on a side held in contact with the heat transfer pipe 5.

The first extending portion 8 and the second extending portion 9 extend from ends of the main body portion 11 in the width direction of each of the heat transfer pipes 5, specifically, the third direction x. The first extending portion 8 extends from one end of the main body portion 11 in the width direction toward an upstream side of the air stream A, specifically, a windward side with respect to the main body portion 11. The second extending portion 9 extends from another end of the main body portion 11 in the width direction toward a downstream side of the air stream A, specifically, a leeward side with respect to the heat transfer pipe 5. In this example, the first extending portion 8 and the second extending portion 9 extend from the main body portion 11 along the third direction x. Each of the first extending portion 8 and the second extending portion 9 has a flat plate shape orthogonal to the thickness direction of each of the heat transfer pipes 5. Further, in this example, when each of the heat exchange members 4 is viewed along the width direction of each of the heat transfer pipes 5, specifically, the third direction x, each of the first extending portion 8 and the second extending portion 9 is arranged to fall within a region of the main body portion 11.

When a dimension of the first extending portion 8 and a dimension of the second extending portion 9 in the third direction x, specifically, a width dimension of the first extending portion 8 and a width dimension of the second extending portion 9 are represented by Lf1 and Lf2, respectively, a total dimension Lf of the extending portions in the third direction x is expressed by a sum (Lf1+Lf2) of the width dimension Lf1 of the first extending portion 8 and the width dimension Lf2 of the second extending portion 9.

Further, when a dimension of the main body portion 11 in the third direction x, which is the width direction of each of the heat transfer pipes 5, specifically, a width dimension of the main body portion 11 is represented by La, the total dimension Lf (=Lf1+Lf2) of the extending portions in the third direction x is equal to or larger than the width dimension La of the main body portion 11. Specifically, a width-dimension ratio R1, which is a ratio of the total dimension Lf (=Lf1+Lf2) of the extending portions in the third direction x to the width dimension La of the main body portion 11, satisfies Expression (1).

$$\text{Width-Dimension Ratio } R1 = Lf/La \geq 1 \quad (1)$$

Further, when a thickness dimension of each of the first extending portion 8 and the second extending portion 9 is represented by Tf and a dimension between the outer peripheral surface of each of the heat transfer pipes 5 and the inner surface of each of the refrigerant flow passages 7, specifically, a dimension of a wall thickness of each of the heat transfer pipes 5 is represented by tp, the thickness dimension Tf of each of the first extending portion 8 and the second extending portion 9 is equal to or smaller than the dimension tp of the wall thickness of each of the heat transfer pipes 5. Specifically, a relationship between the thickness dimension Tf of each of the first extending portion 8 and the second extending portion 9 and the dimension tp of the wall thickness of each of the heat transfer pipes 5 satisfies Expression (2).

$$Tf \leq tp \quad (2)$$

Further, when a dimension of the main body portion 11 in the thickness direction of each of the heat transfer pipes 5, which extends in a direction orthogonal to both of the first direction z and the third direction x, specifically, a thickness dimension of the main body portion 11 is represented by Ta, a thickness-dimension ratio R2, which is a ratio of the thickness dimension Ta of the main body portion 11 to the thickness dimension Tf of each of the first extending portion 8 and the second extending portion 9, is expressed by Expression (3). In this embodiment, the thickness dimension Ta of the main body portion 11 is larger than the thickness dimension Tf of each of the first extending portion 8 and the second extending portion 9.

$$\text{Thickness-Dimension Ratio } R2 = Ta/Tf \quad (3)$$

Further, when the plurality of heat exchange members 4 are viewed along the third direction x, which is the width direction of each of the heat transfer pipes 5, a clearance between two adjacent ones of the main body portions 11 is a minimum clearance 12, which is the narrowest portion of a clearance between two adjacent ones of the heat exchange members 4. A dimension of the minimum clearance 12 in the thickness direction of each of the heat transfer pipes 5 is represented by w.

As illustrated in FIG. 1, a first refrigerant port 13 is formed at an end of the first header tank 2 in the longitudinal direction. A second refrigerant port 14 is formed at an end of the second header tank 3 in the longitudinal direction.

Next, an operation of the heat exchanger 1 is described. The air stream A generated by the operation of the fan (not shown) flows between the plurality of heat exchange members 4 while coming into contact with the first extending portions 8, the main body portion 11, and the second extending portions 9 in the stated order.

When the heat exchanger 1 functions as an evaporator, a gas-liquid refrigerant mixture flows from the first refrigerant port 13 into the first header tank 2. After that, the gas-liquid refrigerant mixture is distributed to the refrigerant flow passages 7 in each of the heat transfer pipes 5 from the first header tank 2 to flow through the refrigerant flow passages 7 toward the second header tank 3.

When the gas-liquid refrigerant mixture flows through the refrigerant flow passages 7, heat is exchanged between the air stream A, which passes between the plurality of heat exchange members 4, and the refrigerant. The gas-liquid refrigerant mixture takes heat from the air stream A and evaporates. When condensed water adheres to surfaces of the heat exchange members 4, the condensed water flows downward along the guide surfaces of the heat exchange members 4 by its own weight, and the condensed water is drained from the surfaces of the heat exchange members 4. After that, the refrigerant having flowed from each of the heat transfer pipes 5 join together in the second header tank 3, and then the refrigerant flows from the second header tank 3 to the second refrigerant port 14.

When the heat exchanger 1 functions as a condenser, a gas refrigerant flows from the second refrigerant port 14 into the second header tank 3. After that, the gas refrigerant is distributed to the refrigerant flow passages 7 in each of the heat transfer pipes 5 from the second header tank 3 to flow through the refrigerant flow passages 7 toward the first header tank 2.

When the gas refrigerant flows through the refrigerant flow passages 7, heat is exchanged between the air stream A, which passes between the plurality of heat exchange members 4, and the refrigerant. The gas refrigerant transfers heat to the air stream A and condenses. After that, the refrigerant having flowed from the heat transfer pipes 5 join together in the first header tank 2, and the refrigerant flows out from the first header tank 2 to the first refrigerant port 13.

In this case, in order to check heat exchange performance of the heat exchanger 1 according to this embodiment, an outside-pipe heat transfer area Ao [$m^2$], an outside-pipe heat transfer coefficient αo [W/($m^2$·K)], an airflow resistance ΔPair [Pa], and a pressure loss ΔPref of the refrigerant in the heat exchanger 1 according to this embodiment were calculated while changing the width-dimension ratio R1, and a windward-side heat exchange efficiency η [W/(K·Pa)] was calculated from the outside-pipe heat transfer area Ao, the outside-pipe heat transfer coefficient αo, and the airflow resistance ΔPair.

The outside-pipe heat transfer area Ao is a total heat transfer area of the plurality of heat exchange members 4 for the air stream. Further, the outside-pipe heat transfer coefficient αo is a heat transfer coefficient of the heat exchange members 4 for the air stream. Further, the airflow resistance ΔPair is a resistance that the air stream has when the air stream passes through the heat exchanger. The airstream-side heat exchange efficiency r is a heat exchange efficiency between the heat exchange members 4 and the air steam, and is expressed by: η=Ao·αo/ΔPair. Further, the pressure loss ΔPref of the refrigerant is a pressure loss of the refrigerant in the refrigerant flow passages 7 of the heat transfer pipes 5.

Further, for a heat exchanger of a comparative example, the outside-pipe heat transfer area Ao, the outside-pipe heat transfer coefficient αo, the airflow resistance ΔPair, the pressure loss ΔPref of the refrigerant, and the air stream-side heat exchange efficiency η were calculated. In the heat exchanger of the comparative example, a plurality of circular pipes are arranged side by side as heat transfer pipes, and plate fins are arranged so as to intersect with the plurality of heat transfer pipes. In the heat exchanger of the comparative example, a diameter of the circular pipe was set to 7 [mm]. Further, a depth dimension of the heat exchanger of the comparative example was set to 20 [mm]. An area of air stream passage surfaces over which the air stream passes is set equal for the heat exchanger 1 according to this embodiment and the heat exchanger of the comparative example.

Further, for each of the parameters, that is, each of the outside-pipe heat transfer area Ao, the outside-pipe heat transfer coefficient αo, the airflow resistance ΔPair, the pressure loss ΔPref of the refrigerant, and the air stream-side heat exchange efficiency q, a percentage of the heat exchanger 1 according to this embodiment to the heat exchanger of the comparative example was obtained as a percentage of each of the parameters to that of the comparative example. Thus, in comparison between the same parameters, when a value of the heat exchanger 1 according to this embodiment is the same as a value of the heat exchanger of the comparative example, the percentage of the parameter to that of the comparative example is obtained as 100%. Further, with the same parameters, when the value of the heat exchanger 1 according to this embodiment is smaller than the value of the heat exchanger of the comparative example, the percentage of the parameter to that of the comparative example becomes smaller than 100%. When the value of the heat exchanger 1 according to this embodiment is larger than the value of the heat exchanger of the comparative example, the percentage of the parameter to that of the comparative example becomes larger than 100%.

Figure 3:
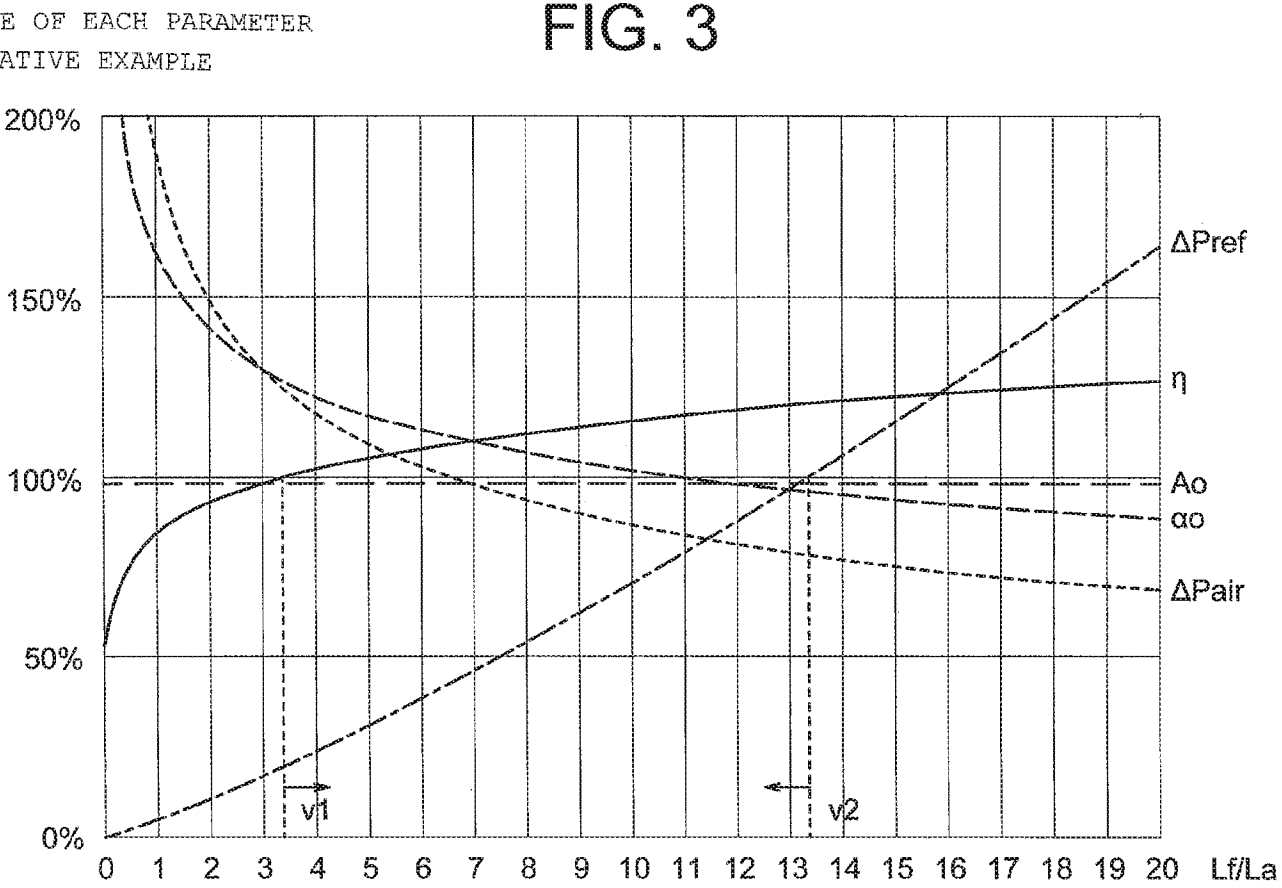
FIG. 3 is a graph for showing a relationship between a percentage of each of parameters to a corresponding one of parameters of a comparative example and a width-dimension ratio R1 in the heat exchanger of FIG. 2.

FIG. 3 is a graph for showing a relationship between the percentage of each of the parameters to a corresponding one of the parameters of the comparative example and the width-dimension ratio R1 in the heat exchanger 1 of FIG. 2. In FIG. 3, each of arrangement pitches FP of the plurality of heat exchangers 4 is set to 1.7 [mm] and the thickness-dimension ratio R2 is set to 10 to calculate the parameters of the heat exchanger 1. As shown in FIG. 3, the following is understood. In the heat exchanger 1 according to this embodiment, even when the width-dimension ratio R1=Lf/La is changed, the outside-pipe heat transfer area Ao does not change from that of the heat exchanger of the comparative example. Meanwhile, in the heat exchanger 1 according to this embodiment, as the width-dimension ratio R1 is increased, the outside-pipe heat transfer coefficient αo gradually decreases from that of the heat exchanger of the comparative example. On the other hand, in the heat exchanger 1 according to this embodiment, as the width-dimension ratio R1 is increased, the airflow resistance ΔPair suddenly decreases. Thus, in the heat exchanger 1 according to this embodiment, an influence of the airflow resistance ΔPair increases. Therefore, as the width-dimension ratio R1 is increased, the air stream-side heat exchange efficiency η rises.

In the heat exchanger, as the air stream-side heat exchange efficiency η becomes higher, the heat exchange efficiency between the refrigerant flowing through the refrigerant flow passages in each of the heat transfer pipes and the air stream outside the heat exchange pipes increases. By referring to FIG. 3, the following is understood. When the width-dimension ratio R1 is equal to or larger than the first value v1, the air stream-side heat exchange efficiency η of the heat exchanger 1 according to this embodiment becomes equal to or larger than the air stream-side heat exchange efficiency η of the heat exchanger of the comparative example. Thus, for the heat exchanger 1 according to this embodiment, improvement of the heat exchange performance can be achieved by setting the width-dimension ratio R1 equal to or larger than the first value v1.

Meanwhile, by referring to FIG. 3, the following is also understood. In the heat exchanger 1 according to this embodiment, as the width-dimension ratio R1 becomes larger, the pressure loss ΔPref of the refrigerant rises. In the heat exchanger, as the pressure loss ΔPref of the refrigerant becomes smaller, the amount of refrigerant flowing through the refrigerant flow passages in each of the heat transfer pipes increases. Hence, the heat exchange efficiency between the refrigerant and the air stream becomes higher. By referring to FIG. 3, the following is understood. When the width-dimension ratio R1 is equal to or smaller than the second value v2, the pressure loss ΔPref of the refrigerant of the heat exchanger 1 according to this embodiment becomes equal to or smaller than the pressure loss ΔPref of the refrigerant of the heat exchanger of the comparative example. Thus, for the heat exchanger 1 according to this embodiment, improvement of the heat exchange performance can be achieved by setting the width-dimension ratio R1 equal to or smaller than the second value v2.

Further, by referring to FIG. 3, the following is understood. In the heat exchanger 1 according to this embodiment, as the width-dimension ratio R1 becomes larger, the air stream-side heat exchange efficiency η rises and the pressure loss ΔPref of the refrigerant rises. Thus, in order to improve the heat exchange performance of the heat exchanger 1 according to this embodiment so that the heat exchange performance of the heat exchanger 1 according to this embodiment becomes higher than the heat exchange performance of the heat exchanger of the comparative example, the second value v2 is required to be equal to or larger than the first value v1.

Thus, in the heat exchanger 1 according to this embodiment, when the width-dimension ratio R1 satisfies Expression (4), the pressure loss ΔPref of the refrigerant can be suppressed while the air stream-side heat exchange efficiency η is improved in comparison to that of the heat exchanger of the comparative example. Thus, the improvement of the heat exchange performance can be achieved.

$$v1 \leq R1 \leq v2 \quad (4)$$

Figure 4:
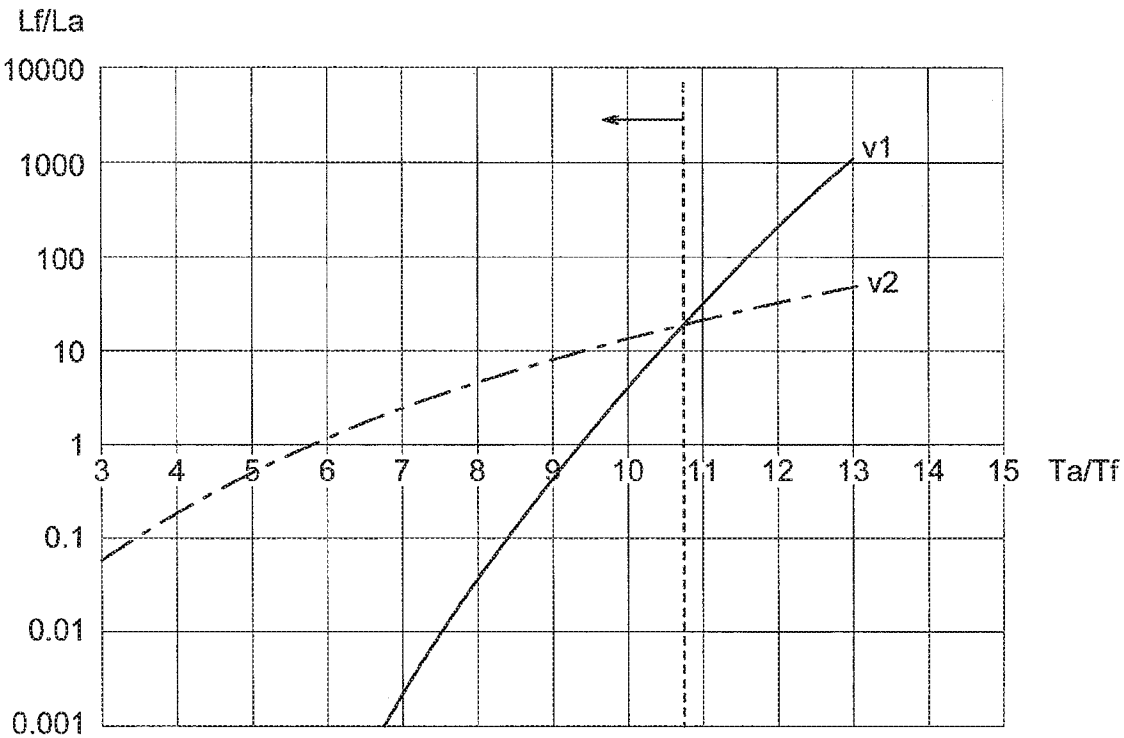
FIG. 4 is a graph for showing a relationship between each of a first value v1 and a second value v2 of the width-dimension ratio R1 and a thickness-dimension ratio R2 in the heat exchanger of FIG. 2.

FIG. 4 is a graph for showing a relationship between each of the first value v1 and the second value v2 of the width-dimension ratio R1 and the thickness-dimension ratio R2 in the heat exchanger 1 of FIG. 2. In FIG. 4, each of the arrangement pitches FP of the plurality of heat exchange members 4 is set to 1.7 [mm], and the first value v1 and the second value v2 are calculated while changing the thickness-dimension ratio R2=Ta/Tf. By referring to FIG. 4, the following is understood. When each of the arrangement pitches FP of the plurality of heat exchange members 4 is set to 1.7 [mm] and the value of the thickness-dimension ratio R2 is 10.8, the first value v1 and the second value v2 become equal to each other. Further, by referring to FIG. 4, the following is also understood. When the thickness-dimension ratio R2 is smaller than 10.8, the second value v2 is larger than the first value v1. Thus, when each of the arrangement pitches FP of the plurality of heat exchange members 4 is set to 1.7 [mm] and the value of the thickness-dimension ratio R2=Ta/Tf is set equal to or smaller than 10.8, the pressure loss ΔPref of the refrigerant can be suppressed while the air stream-side heat exchange efficiency q of the heat exchanger 1 is improved. Thus, the improvement of the heat exchange performance of the heat exchanger 1 according to this embodiment can be achieved.

Figure 5:
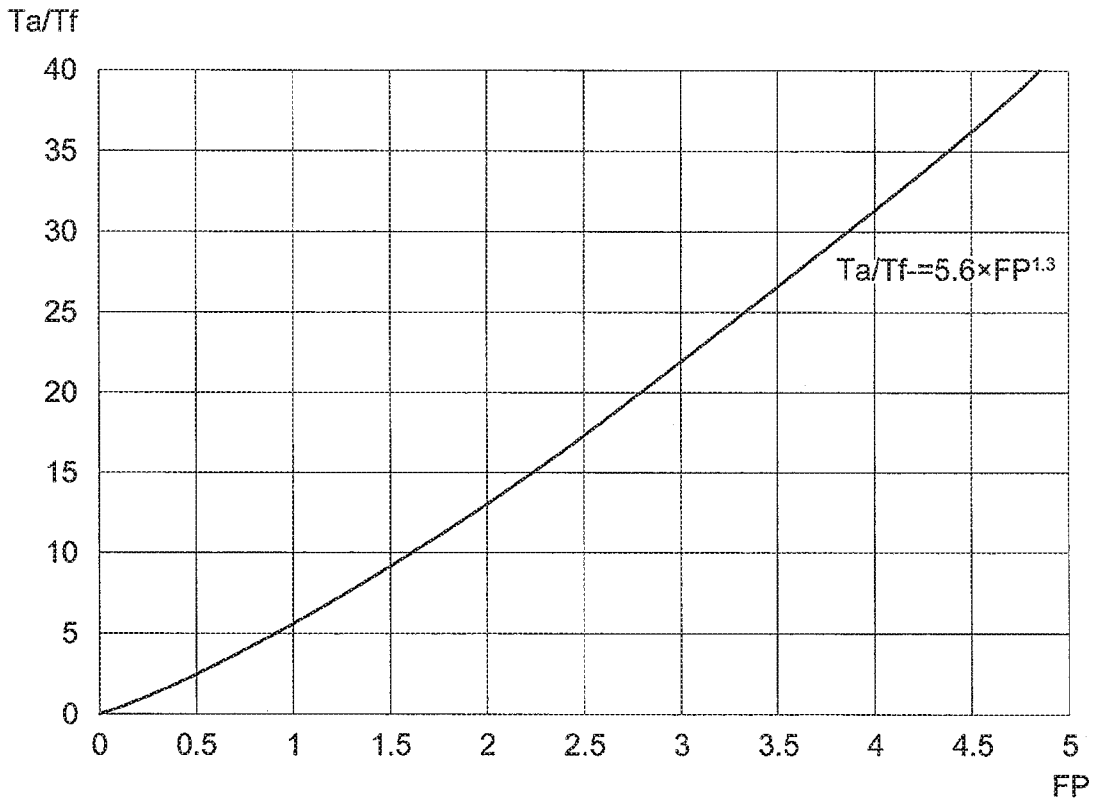
FIG. 5 is a graph for showing the thickness-dimension ratio R2 given when the first value v1 and the second value v2 of the width-dimension ratio R1 become equal to each other and each of arrangement pitches FP of a plurality of heat exchange members in the heat exchanger of FIG. 2.

FIG. 5 is a graph for showing a relationship between the thickness-dimension ratio R2 given when the first value v1 and the second value v2 of the width-dimension ratio R1 become equal to each other and each of the arrangement pitches FP of the plurality of heat exchange members 4 in the heat exchanger 1 of FIG. 2. By referring to FIG. 4 and FIG. 5, the following is understood. When the relationship between the thickness-dimension ratio R2=Ta/Tf and each of the arrangement pitches FP of the plurality of heat exchange members 4 satisfies Expression (5) in the heat exchanger 1 according to this embodiment, the second value v2 becomes equal to or larger than the first value v1.

$$R2 = Ta/Tf \leq 5.6 \times FP^{1.3} \quad (5)$$

When the second value v2 is equal to or larger than the first value v1 in the heat exchanger 1 according to this embodiment, as shown in FIG. 3, the improvement of the heat exchange performance of the heat exchanger 1 according to this embodiment can be achieved in comparison to the heat exchange performance of the heat exchanger of the comparative example. In the heat exchanger 1 according to this embodiment, the relationship between the thickness-dimension ratio R2=Ta/Tf and each of the arrangement pitches FP of the plurality of heat exchange members 4 satisfies Expression (5). As a result, the second value v2 becomes equal to or larger than the first value v1 in the heat exchanger 1 according to this embodiment.

In this example, as shown in FIG. 6, the width dimension La of the main body portion 11 is set to 5.2 [mm], the width dimension Lf1 of the first extending portion 8 is set to 7.4 [mm], and the width dimension Lf2 of the second extending portion 9 is set to 7.4 [mm]. Further, the thickness dimension Ta of the main body portion 11 is set to 0.7 [mm], and the thickness dimension Tf of each of the first extending portion 8, the second extending portion 9, and the overlapping portion 10 is set to 0.1 [mm]. Further, the width dimension Lt of the heat transfer pipe 5 is set to 5.0 [mm], the thickness dimension Tt of the heat transfer pipe 5 is set to 0.6 [mm], and a depth dimension Tb of a portion of the heat transfer pipe 5, which is fitted into the overlapping portion 10 so as to be held in contact therewith, is set to 0.4 [mm]. Each of the arrangement pitches FP of the plurality of heat exchange members 4 is set to 2.2 [mm], the dimension w of the minimum clearance 12 between two adjacent ones of the heat exchange members 4 is set to 1.5 [mm]. The dimension between the outer peripheral surface of the heat transfer pipe 5 and the inner surface of each of the refrigerant flow passages 7, specifically, the dimension tp of the wall thickness of the heat transfer pipe 5 is set to 0.2 [mm], which is larger than the thickness dimension Tf of each of the first extending portion 8, the second extending portion 9, and the overlapping portion 10.

In the heat exchanger 1 described above, the total dimension Lf of the extending portions in the third direction x is equal to or larger than the width dimension La of the main body portion 11. At the same time, the thickness dimension Tf of each of the first extending portion 8 and the second extending portion 9 is equal to or smaller than the dimension tp of the wall thickness of the heat transfer pipe 5. Thus, the thickness of each of the first extending portion 8 and the second extending portion 9 can be reduced while a ratio of the heat transfer area of the first extending portion 8 and the second extending portion 9 to that of each of the heat exchange members 4 is increased. With the dimensions described above, the airflow resistance during the passage of the air stream A through clearances between the plurality of heat exchange members 4 can be reduced. At the same time, promotion of heat conduction through the first extending portion 8 and the second extending portion 9 can be achieved. Accordingly, the heat exchange efficiency of the heat exchanger 1 can be improved, and hence the improvement of the heat exchange performance of the heat exchanger 1 can be achieved. Further, the thickness dimension Tf of each of the first extending portion 8 and the second extending portion 9 is set equal to or smaller than the dimension tp of the wall thickness of the heat transfer pipe 5. Thus, pressure resistance performance of the heat transfer pipe 5 against the refrigerant can be maintained. At the same time, manufacture of the heat transfer pipes 5 through, for example, extrusion can easily be performed. Based on the facts described above, the improvement of the heat exchange performance of the heat exchanger 1 can be achieved while the pressure resistance performance of the heat transfer pipes 5 against the refrigerant is maintained in the heat exchanger 1.

Further, the relationship between the thickness-dimension ratio R2=Ta/Tf and each of the arrangement pitches FP of the plurality of heat exchange members 4 satisfies Expression (5). Thus, the pressure loss ΔPref of the refrigerant can be suppressed while the air stream-side heat exchange efficiency η of the heat exchanger 1 is improved. In this manner, further improvement of the heat exchange performance of the heat exchanger 1 can be achieved.

Further, each of the heat transfer pipes 5 is a flat pipe, and hence a heat transfer area of each of the heat transfer pipes 5 can be increased. Thus, further improvement of the heat exchange performance of the heat exchanger 1 can be achieved.

Second Embodiment

Figure 7:
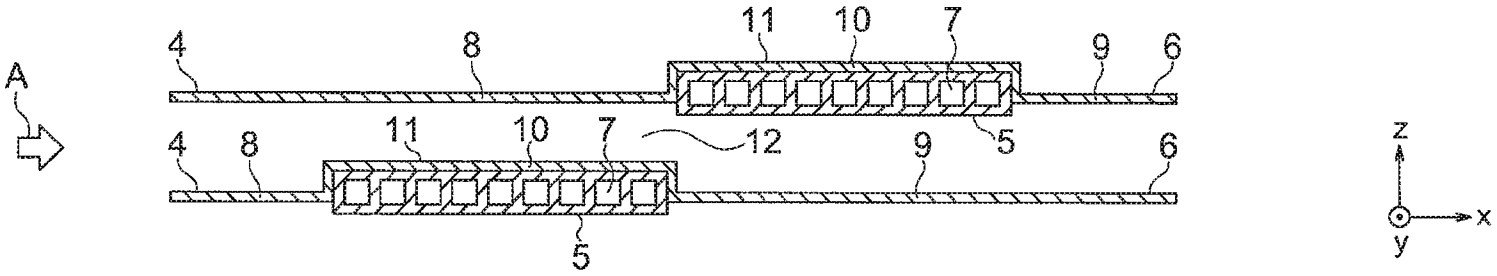
FIG. 7 is a sectional view for illustrating heat exchange members of a heat exchanger according to a second embodiment of the present invention.

FIG. 7 is a sectional view for illustrating heat exchange members 4 of a heat exchanger 1 according to a second embodiment of the present invention. FIG. 7 corresponds to FIG. 2 in the first embodiment. In two adjacent ones of the heat exchange members 4, positions of the main body portions 11 are shifted from each other in the third direction x. In this example, the main body portions 11 are arranged at staggered positions so as to be located alternately in two parallel rows along the first direction z. Further, in this example, when the heat exchange members 4 are viewed along the first direction z, an entire region of one of the heat transfer pipes 5 of two adjacent ones of the heat exchange members 4 is shifted from a region of another one of the heat transfer pipes 5 in the third direction x so as not to overlap the region of the another one of the heat transfer pipes 5.

The plurality of heat exchange members 4 are arranged side by side in the first direction z under a state in which positions of ends of the first extending portions 8 are aligned in the third direction x and positions of ends of the second extending portions 9 are also aligned in the third direction x. The positions of the main body portions 11 of the two adjacent ones of the heat exchange members 4 are shifted from each other in the third direction x. Thus, in each of the heat exchange members 4, the width dimension Lf1 of the first extending portion 8 and the width dimension Lf2 of the second extending portion 9 are different from each other. Specifically, in each of the heat exchange members 4, the width dimension Lf1 of the first extending portion 8 and the width dimension Lf2 of the second extending portion 9 are adjusted in accordance with a position of the heat transfer pipe 5 in the third direction x so that a width dimension of the whole heat exchange member 4 becomes the same for the plurality of heat exchange members 4. With the adjustment described above, in this example, the region of the heat transfer pipe 5 of one of two adjacent ones of the heat exchange members 4 is opposed to the first extending portion 8 of another one of the two adjacent ones of the heat exchange members 4, and the region of the heat transfer pipe 5 of the another one of the two adjacent ones of the heat exchange members 4 is opposed to the second extending portion 9 of the one of two adjacent ones of the heat exchange members 4. Other configurations are the same as those of the first embodiment.

In the heat exchanger 1 described above, the positions of the main body portions 11 of adjacent ones of the heat exchange members 4 are shifted from each other in the third direction x. Thus, the main body portions 11, each having a larger thickness dimension than that of each of the first extending portion 8 and the second extending portion 9, can be prevented from being adjacent to each other. Thus, generation of an extremely small portion of the clearance between adjacent ones of the heat transfer members 4 can be prevented. In this manner, the airflow resistance during the passage of the air stream A through the clearances between the plurality of heat exchange members 4 can be further reduced, and hence further improvement of the heat exchange performance of the heat exchanger 1 can be achieved.

In the example described above, when the heat exchange members 4 are viewed along the first direction z, the entire region of one of the heat transfer pipes 5 of two adjacent ones of the heat exchange members 4 is shifted from the region of the another one of the heat transfer pipes 5 in the third direction x so as not to overlap the region of the another one of the heat transfer pipes 5. However, when the heat exchange members 4 are viewed along the first direction z, only part of the region of one of the heat transfer pipes 5 of two adjacent ones of the heat exchange members 4 may overlap part of the region of the another one of the heat transfer pipes 5. Even with the arrangement described above, most part of the clearance between adjacent ones of the heat exchange members 4 can have a large dimension, and hence the airflow resistance during the passage of the air stream A through the clearances between the plurality of the heat exchange members 4 can be reduced. As a result, the improvement of the heat exchange performance of the heat exchanger 1 can be achieved.

Further, in the first embodiment and the second embodiment, the first extending portion 8 and the second extending portion 9 extend from each of the main body portions 11. However, the first extending portion 8 may be absent, or the second extending portion 9 may be absent. When the first extending portion 8 is absent, the width dimension Lf2 of the second extending portion 9 corresponds to the total dimension Lf of the extending portions. When the second extending portion 9 is absent, the width dimension Lf1 of the first extending portion 8 corresponds to the total dimension Lf of the extending portions. Even with the configuration described above, the improvement of the heat exchange performance of the heat exchanger 1 can be achieved.

Third Embodiment

Figure 8:
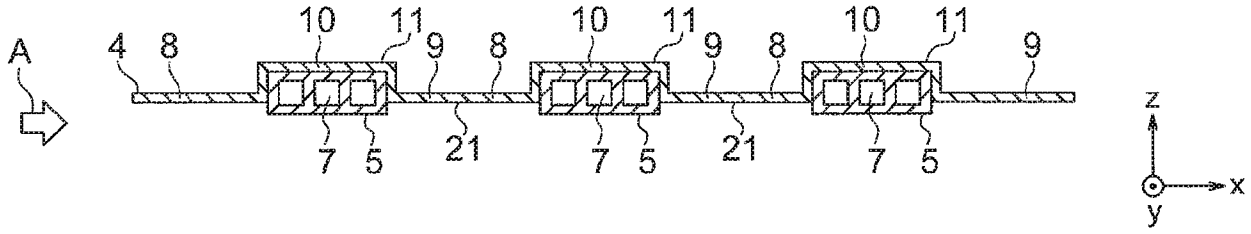
FIG. 8 is a sectional view for illustrating heat exchange members of a heat exchanger according to a third embodiment of the present invention.

FIG. 8 is a sectional view for illustrating heat exchange members 4 of a heat exchanger 1 according to a third embodiment of the present invention. Each of the plurality of heat exchange members 4 includes a plurality of the main body portions 11, the first extending portions 8, and the second extending portions 9. Each of the first extending portion 8 and each of the second extending portions 9 are provided to each corresponding one of the plurality of main body portions 11.

The plurality of main body portions 11 are arranged in the third direction x so as to be spaced apart from each other. A configuration of each of the plurality of main body portions 11 is the same as the configuration of the main body portion 11 according to the first embodiment.

The first extending portion 8 and the second extending portion 9 extend from ends of each of the main body portions 11 in the width direction of each of the heat transfer pipes 5, specifically, in the third direction x. Each of the first extending portions 8 extends from one end of the main body portion 11 in the width direction toward an upstream side of the air stream A, specifically, a windward side with respect to the main body portion 11. Each of the second extending portions 9 extends from another end of the main body portion 11 in the width direction toward a downstream side of the air stream A, specifically, a leeward side with respect to the heat transfer pipe 5. In this example, each of the first extending portions 8 and each of the second extending portions 9 extend along the third direction x. Further, in this example, when each of the heat exchange members 4 is viewed along the width direction of each of the heat transfer pipes 5, specifically, the third direction x, each of the first extending portion 8 and the second extending portion 9 is arranged to fall within a region of the main body portion 11.

The first extending portion 8 and the second extending portion 9 are continuous with the overlapping portion 10 of each of the main body portions 11. The first extending portion 8 and the second extending portion 9, which are arranged between two adjacent ones of the main body portions 11 in the third direction x, are formed so as to be continuous with each other to form a connected extending portion 21. Specifically, in the same heat exchange member 4, the plurality of main body portions 11 are connected to each other through intermediation of the connected extending portion 21 so as to be continuous with each other. In this example, each of the first extending portions 8, each of the second extending portions 9, and each of the overlapping portions 10 form a heat transfer plate 6. Further, in this example, the heat transfer plate 6 is a single member, and the heat transfer plate 6 is a member separate from each of the heat transfer pipes 5.

In this embodiment, a sum of the dimension of each of the first extending portions 8 and the dimension of each of the second extending portions 9 in the third direction x is equal to the dimension Lf of the extending portions in the third direction x. Further, in this embodiment, a sum of the dimension of each of the main body portions 11 in the third direction x is equal to the width dimension La of the main body portions 11 in the third direction x. Other configurations are the same as those of the first embodiment.

As described above, the plurality of main body portions 11 are arranged in the third direction x so as to be spaced apart from each other, and the plurality of main body portions 11 are connected to each other through intermediation of the first extending portions 8 and the second extending portions 9. Thus, the total dimension Lf of the extending portions in the third direction x can be secured while the width dimension of each of the first extending portions 8 and the width dimension of each of the second extending portions 9 are shortened. In this manner, each of the first extending portions 8 and each of the second extending portions 9 can be made less liable to be bent.

In the example described above, the first extending portion 8 is located at one end of each of the heat exchange members 4 in the third direction x, and the second extending portion 9 is located at another end of the heat exchange member 4 in the third direction x. However, the first extending portion 8 located at the one end of the heat exchange member 4 may be absent, or the second extending portion 9 located at the another end of the heat exchange member 4 may be absent. Even with the configuration described above, the improvement of the heat exchange performance of the heat exchanger 1 can be achieved.

Fourth Embodiment

Figure 9:
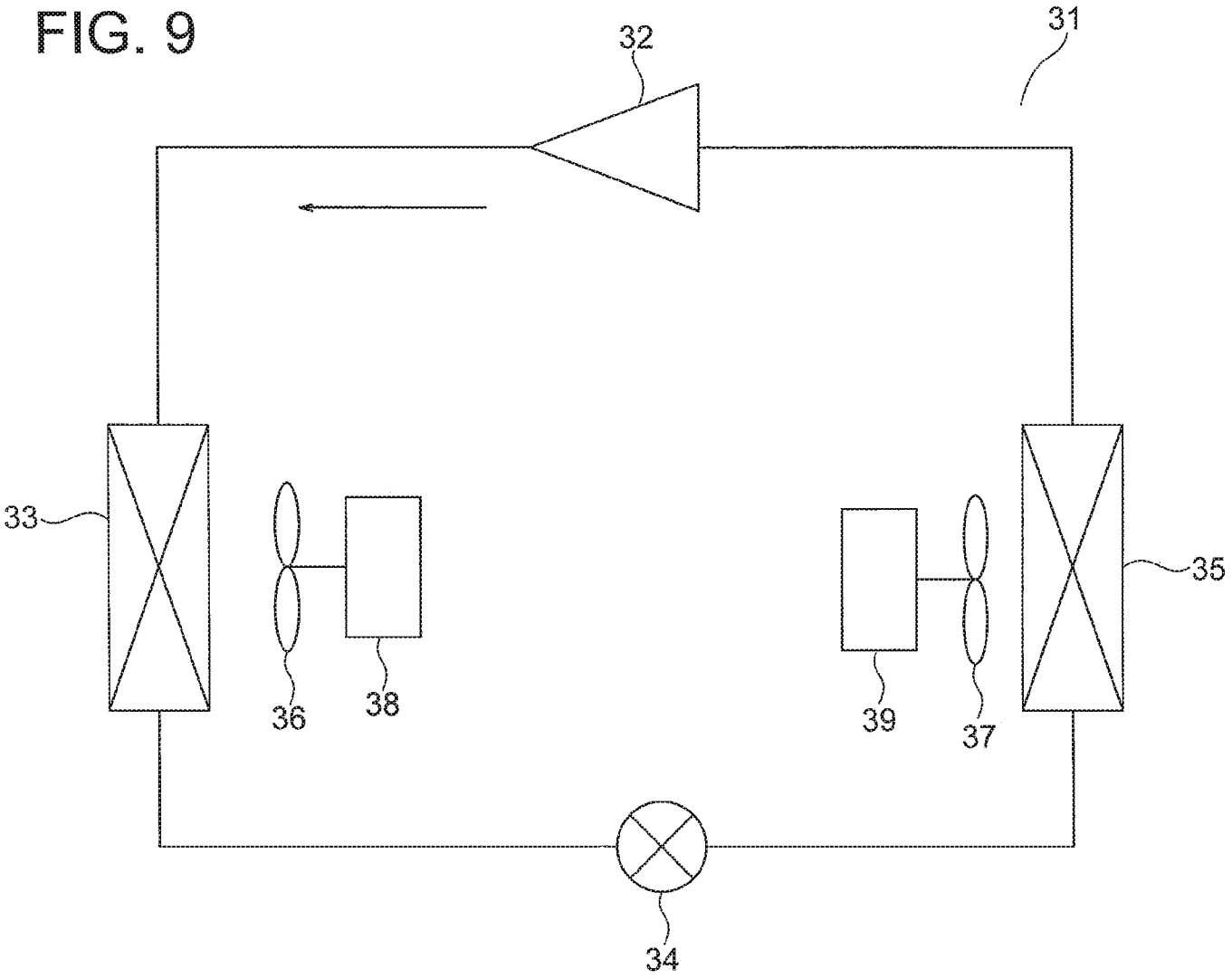
FIG. 9 is a configuration diagram for illustrating a refrigeration cycle apparatus according to a fourth embodiment of the present invention.

FIG. 9 is a configuration diagram for illustrating a refrigeration cycle apparatus according to a fourth embodiment of the present invention. A refrigeration cycle apparatus 31 includes a refrigeration cycle circuit including a compressor 32, a condensing heat exchanger 33, an expansion valve 34, and an evaporating heat exchanger 35. In the refrigeration cycle apparatus 31, a refrigeration cycle is carried out by drive of the compressor 32. In the refrigeration cycle, the refrigerant circulates through the compressor 32, the condensing heat exchanger 33, the expansion valve 34, and the evaporating heat exchanger 35 while changing a phase. In this embodiment, the refrigerant circulating through the refrigeration cycle circuit flows in a direction indicated by the arrow in FIG. 9.

The refrigeration cycle apparatus 31 includes fans 36 and 37 and drive motors 38 and 39. The fans 36 and 37 individually send air streams to the condensing heat exchanger 33 and the evaporating heat exchanger 35, respectively. The drive motors 38 and 39 are configured to individually rotate the fans 36 and 37, respectively. The condensing heat exchanger 33 exchanges heat between the air stream generated by an operation of the fan 36 and the refrigerant. The evaporating heat exchange 35 exchanges heat between the air stream generated by an operation of the fan 37 and the refrigerant.

The refrigerant is compressed in the compressor 32 and is sent to the condensing heat exchanger 33. In the condensing heat exchanger 33, the refrigerant transfers heat to an outside air and condenses. After that, the refrigerant is sent to the expansion valve 34. After being decompressed by the expansion valve 34, the refrigerant is sent to the evaporating heat exchanger 35. After that, the refrigerant takes heat from the outside air in the evaporating heat exchanger 35 and evaporates. Then, the refrigerant returns to the compressor 32.

In this embodiment, the heat exchanger 1 according to any one of the first to third embodiments is used for one or both of the condensing heat exchanger 33 and the evaporating heat exchanger 35. With use of the heat exchanger 1, the refrigeration cycle apparatus having high energy efficiency can be achieved. Further, in this embodiment, the condensing heat exchanger 33 is used as an indoor heat exchanger, and the evaporating heat exchanger 35 is used as an outdoor heat exchanger. The evaporating heat exchanger 35 may be used as an indoor heat exchanger, and the condensing heat exchanger 33 may be used as an outdoor heat exchanger.

Fifth Embodiment

Figure 10:
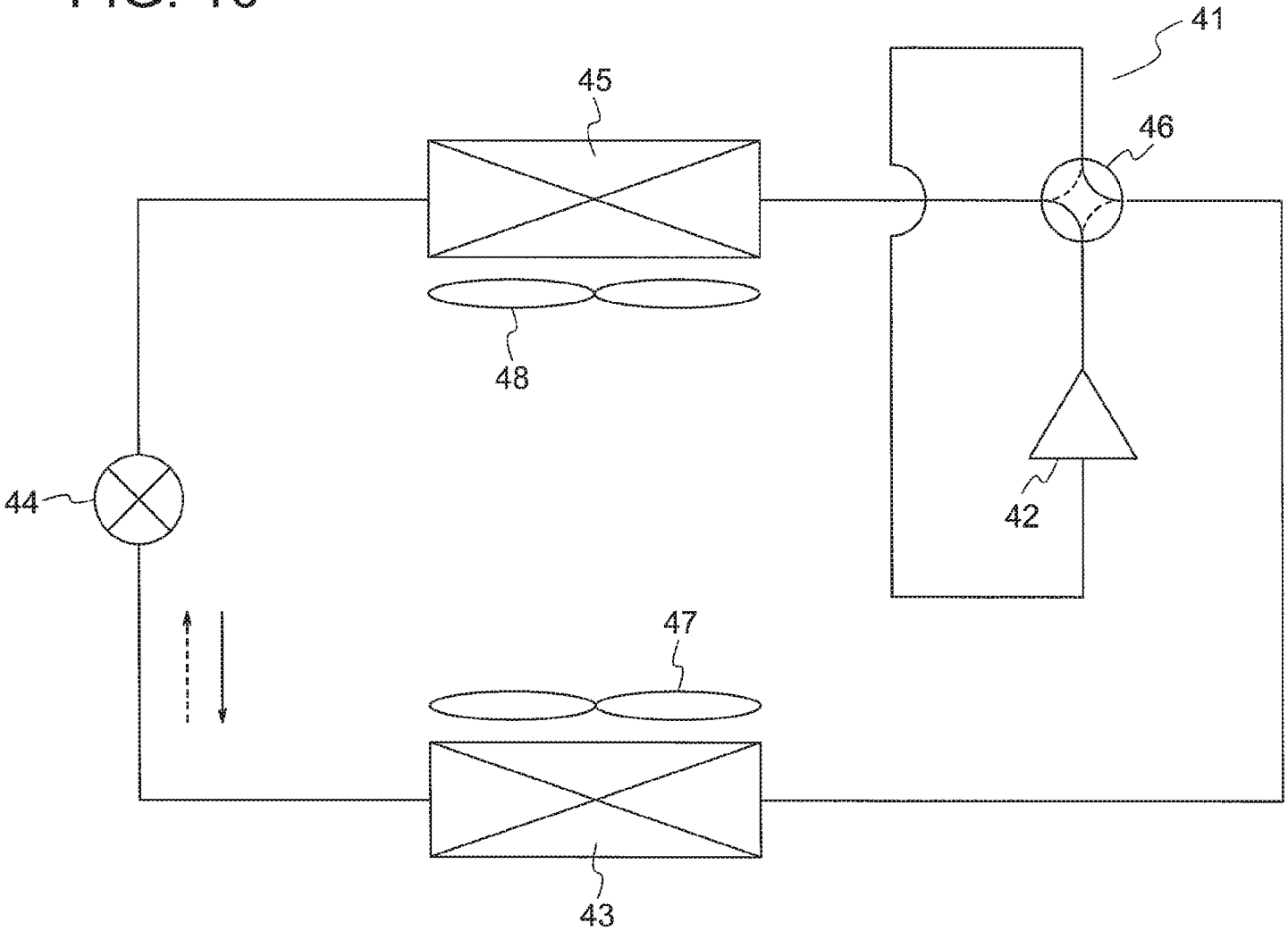
FIG. 10 is a configuration diagram for illustrating a refrigeration cycle apparatus according to a fifth embodiment of the present invention.

FIG. 10 is a configuration diagram for illustrating a refrigeration cycle apparatus according to a fifth embodiment of the present invention. A refrigeration cycle apparatus 41 includes a refrigeration cycle circuit including a compressor 42, an outdoor heat exchanger 43, an expansion valve 44, an indoor heat exchanger 45, and a four-way valve 46. In the refrigeration cycle apparatus 41, a refrigeration cycle is carried out by drive of the compressor 42. In the refrigeration cycle, the refrigerant circulates through the compressor 42, the outdoor heat exchanger 43, the expansion valve 44, and the indoor heat exchanger 45 while changing a phase. In this embodiment, the compressor 42, the outdoor heat exchanger 43, the expansion valve 44, and the four-way valve 46 are provided to an outdoor unit, and the indoor heat exchanger 45 is provided to an indoor unit.

An outdoor fan 47 configured to force the outdoor air to pass through the outdoor heat exchanger 43 as a stream is provided to the outdoor unit. The outdoor heat exchanger 43 exchanges heat between an air stream of the outdoor air, which is generated by an operation of the outdoor fan 47, and the refrigerant. An indoor fan 48 configured to force the indoor air to pass through the indoor heat exchanger 45 as a stream is provided to the indoor unit. The indoor heat exchanger 45 exchanges heat between an air stream of the indoor air, which is generated by an operation of the indoor fan 48, and the refrigerant.

An operation of the refrigeration cycle apparatus 41 can be switched between a cooling operation and a heating operation. The four-way valve 46 is an electromagnetic valve configured to switch a refrigerant flow passage in accordance with the switching of the operation of the refrigeration cycle apparatus 41 between the cooling operation and the heating operation. The four-way valve 46 guides the refrigerant from the compressor 42 to the outdoor heat exchanger 43 and the refrigerant from the indoor heat exchanger 45 to the compressor 42 during the cooling operation, and guides the refrigerant from the compressor 42 to the indoor heat exchanger 45 and the refrigerant from the outdoor heat exchanger 43 to the compressor 42 during the heating operation. In FIG. 10, a direction of flow of the refrigerant during the cooling operation is indicated by the broken-line arrow, and a direction of flow of the refrigerant during the heating operation is indicated by the solid-line arrow.

During the cooling operation of the refrigeration cycle apparatus 41, the refrigerant, which has been compressed in the compressor 42, is sent to the outdoor heat exchanger 43. In the outdoor heat exchanger 43, the refrigerant transfers heat to the outdoor air and condenses. After that, the refrigerant is sent to the expansion valve 44. After being decompressed by the expansion valve 44, the refrigerant is sent to the indoor heat exchanger 45. Then, after the refrigerant takes heat from an indoor air in the indoor heat exchanger 45 and evaporates, the refrigerant returns to the compressor 42. Thus, during the cooling operation of the refrigerant cycle device 41, the outdoor heat exchanger 43 functions as a condenser, and the indoor heat exchanger 45 functions as an evaporator.

During the heating operation of the refrigeration cycle apparatus 41, the refrigerant, which has been compressed in the compressor 42, is sent to the outdoor heat exchanger 45. In the outdoor heat exchanger 45, the refrigerant transfers heat to the indoor air and condenses. After that, the refrigerant is sent to the expansion valve 44. After being decompressed by the expansion valve 44, the refrigerant is sent to the outdoor heat exchanger 43. Then, after the refrigerant takes heat from an outdoor air in the outdoor heat exchanger 43 and evaporates, the refrigerant returns to the compressor 42. Thus, during the heating operation of the refrigerant cycle device 41, the outdoor heat exchanger 43 functions as an evaporator, and the indoor heat exchanger 45 functions as a condenser.

In this embodiment, the heat exchanger 1 according to the first embodiment or the second embodiment is used for one or both of the outdoor heat exchanger 43 and the indoor heat exchanger 45. With use of the heat exchanger 1, the refrigeration cycle apparatus having high energy efficiency can be achieved.

The refrigeration cycle apparatus according to the fourth embodiment and the fifth embodiment is applied to, for example, an air conditioning apparatus or a refrigeration apparatus.

In each of the embodiments described above, each of the heat transfer pipes 5 and each of the heat transfer plates 6 are formed as separate members, and the heat transfer pipe 5 and the overlapping portion 10 form the main body portion 11. However, each of the heat exchange members 4, which includes the first extending portion 8, the second extending portion 9, and the main body portion 11, may be formed as an integrally molded single member. In this case, the main body portion 11 does not include the overlapping portion 10, and corresponds to the heat transfer pipe 5 itself. Thus, in this case, the first extending portion 8 and the second extending portion 9 are directly connected to the heat transfer pipe 5. In this case, the overlapping portion 10 does not overlap the outer peripheral surface of the heat transfer pipe 5. Thus, the width dimension La and the thickness dimension Ta of the main body portion 11 are equal to the width dimension Lt and the thickness dimension Tt of the heat transfer pipe 5 itself, respectively. Further, in this case, each of the heat exchange members 4 is manufactured through extrusion for extruding a heated material through a hole formed in a die to simultaneously form a cross section of the first extending portion 8 and the second extending portion 9 and a cross section of the heat transfer pipe 5. Each of the heat exchange members 4 may also be manufactured through drawing for drawing a material through a hole formed in a die to form 5 the cross section of the first extending portion 8 and the second extending portion 9 and the cross section of the heat transfer pipe.

In each of the embodiments described above, the flat pipe having a flat cross section is used as the heat transfer pipe 5. However, a circular pipe having a circular cross section may be used as the heat transfer pipe 5. In this case, one refrigerant flow passage 7 having a circular cross section is formed in one heat transfer pipe 5.

In each of the heat exchangers 1 and the refrigeration cycle apparatus 31 and 41 according to the embodiments described above, with use of a refrigerant such as R410A, R32, or HFO1234yf, the effects of the heat exchanger 1 and the refrigeration cycle apparatus 31, 41 can be attained.

In each of the embodiments described above, the air and the refrigerant have been described as examples of the working fluid. However, the same effects may be attained even with use of other gases, liquids, and gas-liquid fluid mixtures.

The effects of the heat exchanger 1 and the refrigeration cycle apparatus 31 and 41 according to the embodiments described above can be attained for any refrigerating machine oils such as mineral oil-based ones, alkylbenzene oil-based ones, ester oil-based ones, ether oil-based ones, and fluorine oil-based ones regardless of whether or not the oil is soluble in the refrigerant.

The present invention is not limited to the respective embodiments described above, and can be carried out with various changes within the scope of the present invention.

REFERENCE SIGNS LIST

1 heat exchanger, 4 heat exchange member, 5 heat transfer pipe, 8 first extending portion, 9 second extending portion, 11 main body portion, 31, 41 refrigeration cycle apparatus

The invention claimed is:

1. A heat exchanger, comprising a plurality of heat exchange members arranged side by side in a first direction so as to be spaced apart from each other, wherein each of the plurality of heat exchange members includes:

a main body portion including a heat transfer pipe extending in a second direction intersecting with the first direction; and extending portions provided to the main body portion along the second direction, wherein the extending portions extend from ends of the main body portion in a third direction intersecting with both of the first direction and the second direction, and wherein, when a dimension of the main body portion in the third direction is represented by La [mm], a dimension of the extending portions in the third direction is represented by Lf [mm], a dimension of a wall thickness of each of the heat transfer pipes is represented by tp [mm], and a thickness dimension of each of the extending portions is represented by Tf [mm], a relationship:

$$Tf \leq tp$$

is satisfied;

wherein, when a dimension of each of the main body portions in a direction orthogonal to both of the second direction and the third direction is represented by Ta [mm] and each of arrangement pitches of the plurality of heat exchange members is represented by FP [mm], a relationship:

$$Ta/Tf \leq 5.6 \times FP^{1.3}$$

is satisfied, wherein, the main body portion includes an overlapping portion that has a plate shape, overlaps an outer peripheral surface of the heat transfer pipe, and is continuous with the extending portions, and wherein, the extending portions and the overlapping portion form a heat transfer plate, and the heat transfer plate is a member separate from the heat transfer pipe.

2. The heat exchanger according to claim 1, wherein a relationship:

$$Lf/La \geq 1$$

is satisfied.

3. The heat exchanger according to claim 1, wherein each of the plurality of heat transfer pipes comprises a flat pipe, and wherein a width dimension of each of the flat pipes matches with the third direction.

4. The heat exchanger according to claim 1, wherein positions of adjacent ones of the main body portions are shifted from each other in the third direction.

5. A refrigeration cycle apparatus, comprising the heat exchanger of claim 1.

6. The heat exchanger according to claim 2, wherein each of the plurality of heat transfer pipes comprises a flat pipe, and wherein a width dimension of each of the flat pipes matches with the third direction.

7. The heat exchanger according to claim 2, wherein positions of adjacent ones of the main body portions are shifted from each other in the third direction.

8. The heat exchanger according to claim 3, wherein positions of adjacent ones of the main body portions are shifted from each other in the third direction.

9. The heat exchanger according to claim 6, wherein positions of adjacent ones of the main body portions are shifted from each other in the third direction.

* * * * *